United States Patent [19]

Gatsis

[11] 4,431,510

[45] Feb. 14, 1984

[54] PROCESS FOR PRODUCING HYDROGEN-ENRICHED HYDROCARBONACEOUS PRODUCTS FROM COAL

[75] Inventor: John G. Gatsis, Des Plaines, Ill.

[73] Assignee: UOP Inc., Des Plaines, Ill.

[21] Appl. No.: 364,365

[22] Filed: Apr. 1, 1982

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 1,969,772 | 8/1934 | Alberding | 208/8 LE |
| 1,986,593 | 1/1935 | Morrell | 208/8 LE |
| 3,657,111 | 4/1972 | Gleim | 208/10 |
| 3,755,137 | 8/1973 | Schuman | 208/10 |
| 4,077,867 | 3/1978 | Aldridge et al. | 208/10 |
| 4,300,996 | 11/1981 | Kuehler | 208/10 |
| 4,313,816 | 2/1982 | Veluswamy et al. | 208/10 |
| 4,325,801 | 4/1982 | Kuehler | 208/10 |
| 4,330,393 | 5/1982 | Rosenthal et al. | 208/10 |
| 4,338,183 | 7/1982 | Gatsis | 208/10 |
| 4,350,582 | 9/1982 | Rosenthal et al. | 208/10 X |
| 4,372,838 | 2/1983 | Kulik et al. | 208/10 |

*Primary Examiner*—William G. Wright

*Attorney, Agent, or Firm*—James R. Hoatson, Jr.; John G. Cutts, Jr.; William H. Page, II

[57] ABSTRACT

A process for producing hydrogen-enriched hydrocarbonaceous products from coal which comprises: (a) contacting the coal in a solvent extraction zone at solvent extraction conditions with a coal solvent, hydrogen and a first residual oil containing asphaltenes and at least one finely divided, unsupported metal sulfide to provide a liquid effluent slurry which includes a low boiling hydrocarbon soluble fraction; (b) contacting at least a portion of the liquid effluent slurry from the solvent extraction zone of step (a) with a low boiling hydrocarbon solvent in a solvent separation zone at solvent separation conditions to separate the low boiling hydrocarbon soluble fraction from a low boiling hydrocarbon insoluble fraction which comprises ash, unconverted asphaltenes and finely divided, unsupported metal sulfide; (c) contacting the low boiling hydrocarbon soluble fraction from step (b) with hydrogen and a second residual oil containing asphaltenes and at least one finely divided, unsupported metal sulfide in a hydrocarbon reaction zone at hydrocarbon conversion conditions; and (d) recovering hydrogen-enriched hydrocarbonaceous products from the effluent of the hydrocarbon reaction zone of step (c).

26 Claims, No Drawings

PROCESS FOR PRODUCING HYDROGEN-ENRICHED HYDROCARBONACEOUS PRODUCTS FROM COAL

BACKGROUND OF THE INVENTION

This invention relates to the production of hydrogen-enriched hydrocarbonaceous products from coal. It also relates to a method for liquefying coal using a selective solvent. It particularly relates to a process for obtaining valuable liquid hydrocarbons by the solvent extraction of coal and the subsequent hydroprocessing of the coal extract with a residual oil.

DESCRIPTION OF THE PRIOR ART

It has long been known that hydrocarbon gases, liquids, pitch and chemicals may be obtained in useful form from coal which is mined from the earth. Usually, the prior art has employed destructive distillation or other gasification processes for the conversion of coal into these more valuable and useful products.

Recently the prior art has developed a high pressure hydrogenation of coal technique to effectuate such conversion. Still more recently, methods involving solvent extraction techniques have been developed for obtaining useful fuels and chemicals from coal whereby the coal is contacted with a selective solvent which acts as a hydrogen-donor for supplying sufficient hydrogen to the coal to aid in converting it into a liquid state. Following the solvent extraction step the prior art schemes have utilized various recovery procedures and processing techniques for increasing the value and utility of recovered hydrocarbons together with retorting or coking of the residual materials obtained from the solvent extraction step to further convert these coal derived products into more commercially valuable products.

Furthermore, the prior art has taught the use of various catalysts to enhance the recovery of hydrocarbons from coal liquefaction. In previous procedures, there has been a remaining persistent problem and that is the problem of recovering the catalyst from the hydrocarbon product and the residual ash. Because of the cost of catalysts, it has been thought that for a coal liquefaction process to be economical, the catalyst must be recovered and subsequently recycled. An alternative would be to utilize a once-through or throw-away catalyst, which would only have to be separated from the hydrocarbon product and could be discarded with the residual ash.

Therefore, for these and other reasons, none of the aforementioned prior art procedures have been sufficiently commercially attractive or feasible to warrant widespread commercial exploitation of converting coal into valuable liquid products. Generally, the deficiencies in the prior art schemes have not only involved capital investment problems and lack of suitable and economical catalyst systems, but have also involved liquid product quality and quantity problems which have yet to be solved in an economical and facile manner.

Since it is clear to those skilled in the art that the vast mineral resources of bituminous coal represent an extremely important supply of energy and an extremely important source of raw materials for valuable chemicals, it would be desirable to improve upon the prior art techniques, particularly the solvent extraction step in order to reduce the cost of obtaining high quality petroleum-type product from coal.

BRIEF SUMMARY OF THE INVENTION

One embodiment of the present invention is a process for producing hydrogen-enriched hydrocarbonaceous products from coal which comprises: (a) contacting the coal in a solvent extraction zone at solvent extraction conditions with a coal solvent, hydrogen and a first residual oil containing asphaltenes and at least one finely divided, unsupported metal sulfide to provide a liquid effluent slurry which includes a low boiling hydrocarbon soluble fraction; (b) contacting at least a portion of the liquid effluent slurry from the solvent extraction zone of step (a) with a low boiling hydrocarbon solvent in a solvent separation zone at solvent separation conditions to separate the low boiling hydrocarbon soluble fraction from a low boiling hydrocarbon insoluble fraction which comprises ash, unconverted asphaltenes and finely divided, unsupported metal sulfide; (c) contacting the low boiling hydrocarbon soluble fraction from step (b) with hydrogen and a second residual oil containing asphaltenes and at least one finely divided, unsupported metal sulfide in a hydrocarbon reaction zone at hydrocarbon conversion conditions; and (d) recovering hydrogen-enriched hydrocarbonaceous products from the effluent of the hydrocarbon reaction zone of step (c).

Other embodiments of the present invention encompass further details such as types of coal, preferred solvents, types of residual oil, preferred metal sulfides, and operating conditions including preferred temperatures and pressures, all of which are hereinafter disclosed in the following discussion of each of these facets of the invention.

DETAILED DESCRIPTION OF THE INVENTION

The present invention comprises steps for producing hydrogen-enriched hydrocarbonaceous products from coal which comprises:

(a) contacting the coal in a solvent extraction zone at solvent extraction conditions with a coal solvent, hydrogen and a first residual oil containing asphaltenes and at least one finely divided, unsupported metal sulfide to provide a liquid effluent slurry which includes a low boiling hydrocarbon soluble fraction; (b) contacting at least a portion of the liquid effluent slurry from the solvent extraction zone of step (a) with a low boiling hydrocarbon solvent in a solvent separation zone at solvent separation conditions to separate the low boiling hydrocarbon soluble fraction from a low boiling hydrocarbon insoluble fraction which comprises ash, uncoverted asphaltenes and finely divided, unsupported metal sulfide; (c) contacting the low boiling hydrocarbon soluble fraction from step (b) with hydrogen and a second residual oil containing asphaltenes and at least one finely divided, unsupported metal sulfide in a hydrocarbon reaction zone at hydrocarbon conversion conditions; and (d) recovering hydrogen-enriched hydrocarbonaceous products from the effluent of the hydrocarbon reaction zone of step (c).

Thus, it is to be noted from the summary of the present invention presented hereinabove that the benefits to be derived from the practice thereof are predicated on the presence of a residual oil containing asphaltenes and at least one finely divided, unsupported metal sulfide during both the solvent extraction step and the hydroconversion step which hydroconversion step is performed after the solvent separation step. It is believed that one of the reasons the practice of this invention produces such desirable results is that the residual oil improves the total conversion of the coal extract, rendering the ash more readily separable and producing a liquid coal extract having a high hydrogen content than would otherwise be obtained. Furthermore, it is believed that the residual oil enhances the hydroconversion of the liquid coal extract in the latter stage of the process of the present invention.

The coal suitable for use in the practice of the present inventive process is of the bituminous type, such as Pittsburgh Seam Coal. More preferably, however, the bituminous coal is a high volatile content coal having a volatile content greater than about 20% by weight m.a.f. coal (moisture and ash-free coal). Although the invention will be described with reference to the conversion of bituminous coal to valuable liquid hydrocarbons, it is within the concept of the present invention to apply the inventive process to sub-bituminous coal, lignite, and other solid carbonaceous materials of natural origin. For convenience, therefore, the term "coal" is intended to include all materials with the class consisting of bituminous coal, sub-bituminous coal, lignite, and other solid carbonaceous materials of natural origin.

Suitable coal solvents for use in the practice of this invention are those which are preferably of the hydrogen-donor type and are at least partially hydrogenated and include naphthalenic hydrocarbons. Preferably, the solvent is one which is in liquid phase at the recommended temperature and pressure for extraction. Mixtures of hydrocarbons are generally employed as the solvent and, preferably, are derived from intermediate or final products obtained from subsequent processing following the practice of this invention. A preferred coal solvent comprises a hydrogenated coal oil which has been hydrogenated to convert at least about 80% of the asphaltenes. Typically, the coal solvent hydrocarbons or mixtures of hydrocarbons boil between about 500° F. and 800° F. Examples of other suitable solvents are tetrahydronaphthalene (Tetralin), Decalin, methylnaphthalene, dimethylnaphthalene, etc.

Apparatus for use in pulverizing the lump or coarse coal feed to the present invention may be of any type known to those skilled in the art. Conventional ball mills or rod mills may be used with satisfactory results. Preferably, the apparatus must be able to pulverize lump or coarse coal in the presence of significant quantities of liquid solvent without difficulty. Those skilled in the art are familiar with the kinds of apparatus for processing wet solids and the crushing and grinding thereof, such that no detailed discussion of the apparatus need be presented herein. The primary requirement for crushing and grinding of the lump coal is that coarse coal usually having an average particle diameter in excess of 0.08 inch and, typically, about 0.25 to 2.0 inches must be processed thereto and reduced in size to an average particle diameter which would be of at least 8 Tyler screen size and, preferably, would be reduced to an average particle size of 14 Tyler screen size. As used herein the term "Tyler screen" refers in all instances to the commercial Tyler Standard Screens.

The operation of the pulverization equipment is preferably performed so that the oversized material, that is, greater in size than the 8 Tyler screen size, be separated and returned to the apparatus for further pulverization. The utilization of the closed circuit technique is well known to those skilled in the art and is preferred in the practice of this invention. Unless otherwise stated, closed circuit operation of the pulverization equipment will be deemed inherent in the practice of this invention.

Following the size reduction step wherein the oversized solid materials have been separated from the effluent of the pulverization zone, comminuted coal is passed into a solvent extraction zone which, in effect, is a reaction zone for the substantial conversion of the coal into liquid coal extract.

The operating conditions for the solvent extraction zone include a temperature from about 400° F. to about 950° F., a pressure from about 500 to about 5,000 psig, a solvent to coal weight ratio from about 0.1 to about 10, a residence time from about 30 seconds to about 10 hours, a residual oil to coal weight ratio from about 0.01 to about 10 based on m.a.f. coal and a hydrogen circulation rate from about 1000 to about 10,000 standard cubic feet per barrel of feed.

Hydrogenation in the extraction zone, generally, accomplishes the following functions: transfer of hydrogen directly to coal molecules; transfer of hydrogen to hydrogen-donor molecules; transfer of hydrogen from hydrogen-donor molecules to coal molecules; and various combinations of the above.

The catalytic conversion performed by the metal sulfide catalyst may be enhanced by the admixture of hydrogen sulfide with the hydrogen during the practice of the present invention. Hydrogen sulfide is preferably present during the contacting of the coal with hydrogen in an amount to provide a hydrogen to hydrogen sulfide molar ratio from about 2 to about 200 and more preferably from about 4 to about 100.

The extraction of coal by means of a selective solvent is by definition at least a partial conversion of the coal since not only is the coal reacted with hydrogen which is transferred from the solvent, but is also reacted with the hydrogen which is added during the extraction step. In addition, there is also a solution phenomenon which actually dissolves the coal which has accepted the hydrogen into the solvent. Therefore, as used herein, the terms "liquid coal extract" and "liquid coal fraction" or other words of similar import are intended to include the liquid product which is obtained from the solvent extraction of the coal with the selective solvent in the presence of the residual oil containing asphaltenes and at least one finely divided, unsupported metal sulfide and generally has been described on the basis of being "solvent-free" even though a portion of the extract comprises hydrocarbons suitable for use as the solvent.

A suitable source of residual oil containing asphaltenes and at least one finely divided, unsupported metal sulfide may be selected from a high metal content, heavy whole crude, a high metal content atmospheric crude tower bottoms, or a high metal content vacuum tower bottoms. A preferred high metal containing residual oil is a catalyst sludge from a slurry catalyst hydrotreatment of a high metal content hydrocarbon. The finely divided, unsupported metal sulfide is usually present in the residual oil in an amount greater than about 100 ppm by weight based on the elemental metal. A preferred range of the finely divided, unsupported metal sulfide is from about 0.01 to about 25 weight percent based on the elemental metal and on the residual oil. A more preferred range of the finely divided, unsupported metal sulfide is from about 2.0 to about 10 weight percent based on the elemental metal and on the residual oil.

In some cases where the residual oil does not contain an adequate amount of finely divided metal sulfide, additional metal sulfide or a prescursor thereof may be added to the solvent extraction zone to obtain the desired results. The additional metal sulfide may originate from an external source or may be recycled from a subsequent step wherein said metal sulfide is segregated and recovered.

The finely divided, unsupported metal sulfide has a nominal diameter or particle size of at least one millimicron with a preferred range of from about one micron to about 2000 microns and with a more preferred range from about one micron to about 100 microns. The finely divided, unsupported metal sulfide may be selected from any convenient catalytic metal sulfide. Such metals may be selected from Group V-B, Group VI-B, and Group VIII of the Periodic Table. Preferred metals include vanadium, molybdenum, tungsten, iron, cobalt and nickel.

High metal content hydrocarbons are unsuitable for hydrotreating in a conventional fixed bed hydrotreater because the metals are deposited on the catalyst at a rapid rate which not only physically plugs the flow of the reactants through the reaction zone but also masks the small catalytic sites. This physical plugging precludes long, uninterrupted operation of the hydrotreater which is highly disruptive of the entire processing complex. The prior art describes processes which are much more adaptable to the hydrotreating of high metals hydrocarbons. In general, a facile method for hydrotreating high metals hydrocarbons is via a catalyst slurry process whereby the hydrocarbon is admixed with hydrogen and a finely divided metal catalyst or metal catalyst precursor and subjected to elevated temperature and pressure in a reaction zone. The reaction zone effluent is separated to yield a hydrotreated hydrocarbon and a catalyst sludge containing asphaltenes and at least one metal sulfide. Many of the high metals hydrocarbons which are processed in a slurry fashion contain nickel, vanadium and iron. These indigenous metals may be converted in the process to form metal sulfides which are separated from the hydrogenated hydrocarbons and may then be recycled to fresh hydrocarbon feed as a catalyst source. In some cases, where the catalyst requirements are capable of being generated from the feedstock, an initial catalyst supply may be added to the process during start-up. In other cases where the metals level of the feedstock is too low to permit catalyst generation in sufficient quantities to sustain the process, additional metal catalyst or catalyst precursors may be added. Such metals may be selected from Group V-B, Group VI-B, and Group VIII of the Periodic Table. The above mentioned process is a suitable source for catalyst sludge which is suitable for use in the present invention.

A typical residual oil catalyst sludge containing asphaltenes and at least one finely divided, unsupported metal sulfide which was a drag stream from a high metal hydrocarbon conversion process contained 1.4 weight percent vanadium, 0.12 weight percent nickel, 59.3 weight percent asphaltenes (defined as heptane insolubles) and 7.32 weight percent toluene insolubles.

After the feed to the solvent extraction zone has been subjected to the above mentioned solvent extraction conditions, the effluent of the extraction zone is separated to remove the normally gaseous components such as hydrogen, hydrogen sulfide and light hydrocarbons. The resulting liquid effluent slurry comprises liquid coal extract, coal ash, unconverted asphaltenes, solvent, and finely-divided, unsupported metal sulfide and is contacted with a low boiling hydrocarbon solvent in a solvent separation zone to produce a low boiling hydrocarbon soluble stream and a low boiling hydrocarbon insoluble stream which comprises ash, unconverted asphaltenes and finely-divided, unsupported metal sulfide.

Suitable low boiling hydrocarbons which are useful in the solvent separation zone of the present invention include ethane, propane, butane, isobutane, pentane, isopentane, neopentane, hexane, isoheptane, heptane, mono-olefinic counterparts thereof, etc. Aromatic hydrocarbons may also be added to enhance the solvent separation. The solvent separation may suitably be conducted at conditions which include low boiling hydrocarbon solvent to liquid effluent slurry volume ratio from about 0.5 to about 10, a temperature from about 32° F. to about 500° F. and a pressure from about ambient to about 700 psig.

A portion of the low boiling hydrocarbon insoluble stream which comprises ash, unconverted asphaltenes and finely-divided, unsupported metal sulfide may be recycled to the solvent extraction zone, used as a source of unsupported metal sulfide in further hydrocarbon processing, used elsewhere or discarded.

The low boiling hydrocarbon soluble stream resulting from the hereinabove described solvent separation zone is contacted with hydrogen and a second residual oil containing asphaltenes and at least one finely divided, unsupported metal sulfide in a hydrocarbon reaction zone at hydrocarbon conversion conditions. The hydrogen which is present in the hydrocarbon reaction zone or the solvent extraction zone may be supplied from any convenient source such as a hydrogen manufacturing plant or a hydrogen-rich off gas from a catalytic hydrocarbon reforming process unit. Hydrogen-rich streams from the instant process may be recovered and recycled. In accordance with the present invention, the residual oil containing asphaltenes and at least one finely-divided, unsupported metal sulfide may be selected from any of the residual oils hereinbefore described. The general characteristic of the finely-divided unsupported metal sulfide required in the hydrocarbon reaction zone are as hereinabove described. The residual oil or mixture thereof which is selected for feed to the hydrocarbon reaction zone need not necessarily be the same residual oil or mixture thereof which is selected for feed to the solvent extraction zone. The catalytic conversion performed by the metal sulfide catalyst may be enhanced by the admixture of hydrogen sulfide with the hydrogen as described hereinbefore.

The operating conditions for the hydrocarbon reaction zone include a temperature from about 400° F. to about 950° F., a pressure from about 500 to about 5000 psig, a residual oil to low boiling hydrocarbon soluble stream weight ratio from about 0.1 to about 10, a residence time from about 30 seconds to about 10 hours and a hydrogen circulation rate from about 1000 to about 10,000 standard cubic feet per barrel of feed (SCFB).

After the feed to the hydrocarbon reaction zone has been subjected to hydrocarbon conversion conditions, the effluent of the reaction zone is separated to remove the normally gaseous components such as hydrogen, hydrogen sulfide and light hydrocarbons. The resulting slurry comprises liquid coal extract, unconverted asphaltenes and finely-divided, unsupported metal sulfide and is subsequently processed to recover a hydrogen-enriched hydrocarbonaceous product. Subsequently processing for the recovery of the product may include solvent deashing for the recovery of the finely-divided, unsupported metal sulfide and fractionation for the recovery and separation of the hydrocarbon products. Typically, these recovery facilities comprise fractionation columns for the separation therein of the liquid coal extract into products such as normally gaseous hydrocarbons, relatively light hydrocarbons, middle distillate oil, relatively heavy hydrocarbons comprising materials suitable for use as a coal solvent and a bottoms fraction comprising residue material which is suitable for fuel. In essence, therefore, the valuable liquid hydrocarbons recovered from the liquid coal extract include, for example, gasoline boiling range products and/or chemicals, aromatic hydrocarbon-containing fractions, heavy fuel oil fractions, and the like, the utility of which is well known to those skilled in the art.

The following example is given to further illustrate the coal liquefaction process of the present invention. It is understood that this example is to be illustrative rather than restrictive. Specific coal, solvents, recycle streams, processing techniques, operating conditions and other details are presented for description but it is not intended that the invention be limited to the specifics, nor is it intended that the process of this invention be limited to the particulars mentioned.

EXAMPLE

In this example, the experiments were conducted batch-wise in a rocker autoclave with a capacity of 1800 cc. This example demonstrates a preferred embodiment of the present invention and the production of high quality liquid hydrocarbons from coal with excellent yields.

A one hundred gram sample of finely divided Illinois No. 6 coal having the characteristics present in Table I was charged to the autoclave together with, in accordance with the process of the present invention, 100 grams of a catalyst sludge containing asphaltenes and a finely divided vanadium sulfide having the characteristics presented in Table II, and 106.5 grams of a coal liquefaction derived full boiling material acting as a coal solvent and more fully described and characterized in Table III. About 10.1 grams of finely divided vanadium sulfide were added to the reaction mixture to effect simulation of a catalyst sludge hving a total elemental vanadium content of 4.28wt.%. The autoclave was then pressured with a 10/90 hydrogen sulfide-hydrogen molar mixture to about 750 psig and then pressured with pure hydrogen to about 1500 psig. The charged autoclave was then heated to a temperature of about 735° F. and maintained at a pressure of about 2500 psig for one hour. The cooled contents of the autoclave were recovered and extracted with toluene at atmospheric temperature and pressure with a toluene to slurry ratio of about 5 to produce a liquid product and a toluene insoluble fraction containing ash, uncoverted coal and vanadium sulfide. The toluene extracted fraction was then stripped of toluene at atmospheric pressure to yield a coal liquid product which weighed 266 grams and contained 9.86 weight percent heptane insolubles, 1.69 weight percent toluene insolubles, 87.38 weight percent carbon, 8.58 weight percent hydrogen, and 1.35 weight percent sulfur. Recovery was also made of 18.5 grams of water and 4.4 grams of hydrocarbon gas. The uncoverted coal was 3.9 weight percent based on the m.a.f. coal feed. The catalyst sludge, the solvent, and the liquid product contained 52.8 grams, 7.5 grams and 26.2 grams of heptane insolubles, respectively, while the ratio of heptane insolubles in the liquid product to heptane insolubles in the charge, excluding coal, was 0.43. The results of this coal solvation or liquefaction as hereinabove described are presented in Table IV.

About 200 grams of the coal liquid product derived from the hereinabove described coal solvation or liquefaction was admixed with about 206.6 grams of topped Boscan crude oil. The characteristics of the topped Boscan crude oil are presented in Table V. The topped Boscan crude oil was supplemented with 49.8 grams of an isopentane insoluble sludge which contained asphaltenes, and 12.8 weight percent of finely divided vanadium sulfide, calculated as the elemental metal. The admixture of the coal liquid product, the topped Boscan crude oil and the supplemental isopentane insoluble sludge was charged to the autoclave. The autoclave was then pressured with a 10/90 hydrogen sulfide-hydrogen molar mixture to about 1250 psig and then pressured with pure hydrogen to about 2200 psig. The charged autoclave was then heated to a temperature of about 735° F. and maintained at a pressure of about 3000 psig for one hour. The cooled contents of the autoclave were recovered with toluene and then the toluene was flashed off to yield a toluene-free product which weighed 387.8 grams. The toluene-free product was solvent separated with 5 weight parts isopentane to one weight part product to yield 317.7 grams of isopentane soluble product. The results of the hydrotreatment and an analysis of the recovered isopentane soluble product are presented in Table VI.

From the foregoing description and example, it is apparent that the process of the present invention provides an advantageous method for the production of high quality liquid petroleum substitutes from coal.

TABLE I

| ANALYSIS OF ILLINOIS NO. 6 COAL | |
|---|---|
| Carbon, wt. % | 70.05 |
| Hydrogen, wt. % | 5.88 |
| Oxygen, wt. % | 9.01 |
| Sulfur, wt. % | 2.68 |
| Nitrogen, wt. % | 1.20 |
| Ash, wt. % | 9.02 |
| Moisture (Water), wt. % | 2.15 |

TABLE II

| ANALYSIS OF CATALYST SLUDGE | |
|---|---|
| Vanadium, wt. % | 1.40 |
| Nickel, wt. % | 0.12 |
| Heptane Insolubles, wt. % | 59.3 |
| Toluene Insolubles, wt. % | 7.32 |
| Viscosity, Centistokes at 450° F. | 1300 |

TABLE III

| COAL DERIVED SOLVENT | |
|---|---|
| API Gravity at 60° F. | 5.5 |
| Distillation, °F. | |
| IBP, | 360 |
| 20% | 538 |
| 50% | 672 |
| 70% | 822 |
| 82% | 1000 |

TABLE III-continued

| COAL DERIVED SOLVENT | |
|---|---|
| SUS Viscosity at 210° F. | 59.4 |

TABLE IV

| COAL CONVERSION SUMMARY | |
|---|---|
| COAL FEED, grams | 100 |
| CATALYST SLUDGE, grams | 100 |
| SOLVENT, grams | 106.5 |
| ADDITIONAL CATALYST, grams of $VS_4$ | 10.1 |
| LIQUID PRODUCT, grams | 266 |
| HEPTANE INSOLUBLES, WT. % | 9.86 |
| TOLUENE INSOLUBLES, WT. % | 1.69 |
| INSOLUBLES, grams | 17.7 |
| CARBON, WT. % | 17.98 |
| HYDROGEN, WT. % | 1.78 |
| WATER, grams | 18.5 |
| HYDROCARBON GAS, grams | 4.4 |
| UNCONVERTED COAL, WT. % MAF | 3.9 |
| HEPTANE INSOLUBLES CHARGED, grams | |
| CATALYST SLUDGE | 52.8 |
| SOLVENT | 7.5 |
| HEPTANE INSOLUBLES IN LIQUID PRODUCTS, grams | 26.2 |
| HEPTANE INSOLUBLES RATIO (LIQUID PRODUCT/CHARGE) | 0.43 |

TABLE V

| ANALYSIS OF TOPPED BOSCAN CRUDE OIL | |
|---|---|
| Gravity, °API 60° F. | 5.4 |
| Insolubles, wt. % | |
| Pentane | 20.96 |
| Heptane | 17.36 |
| Carbon, weight percent | 82.83 |
| Hydrogen, | 10.46 |
| Sulfur | 6.21 |
| Nitrogen | 0.74 |
| Metals, weight ppm | |
| Nickel | 122 |
| Vanadium | 1340 |

TABLE VI

| HYDROTREATMENT SUMMARY, STEP (C) | |
|---|---|
| COAL LIQUID PRODUCT, grams | 200 |
| TOPPED BOSCAN CRUDE OIL, grams | 206.6 |
| ISOPENTANE-INSOLUBLE SLUDGE, grams | 49.8 |
| LIQUID PRODUCT, grams | 387.8 |
| ISOPENTANE SOLUBLE PRODUCT, grams | 317.7 |
| ISOPENTANE SOLUBLE PRODUCT ANALYSIS | |
| CARBON, WEIGHT PERCENT | 84.6 |
| HYDROGEN, WEIGHT PERCENT | 11.4 |
| SULFUR, WEIGHT PERCENT | 3.6 |
| NITROGEN, WEIGHT PERCENT | 0.4 |
| NICKEL, WEIGHT PPM | 2.8 |
| VANADIUM, WEIGHT PPM | 30 |

I claim:

1. A process for producing hydrogen-enriched hydrocarbonaceous products from coal which comprises:

(a) contacting said coal in a solvent extraction zone at solvent extraction conditions with a coal solvent, hydrogen and in addition to said solvent a first residual oil containing asphaltenes and at least one finely divided, unsupported metal sulfide to provide a liquid effluent slurry which includes a low boiling hydrocarbon soluble fraction;

(b) contacting at least a portion of said liquid effluent slurry from the solvent extraction zone of step (a) with a low boiling hydrocarbon solvent in a solvent separation zone at solvent separation conditions to separate said low boiling hydrocarbon soluble fraction from a low boiling hydrocarbon insoluble fraction which comprises ash, unconverted asphaltenes and finely divided, unsupported metal sulfide;

(c) contacting the low boiling hydrocarbon soluble fraction from step (b) with hydrogen and a second residual oil containing asphaltenes and at least one finely divided, unsupported metal sulfide in a hydrocarbon reaction zone at hydrocarbon conversion conditions; and (d) recovering hydrogen-enriched hydrocarbonaceous products from the effluent of the hydrocarbon reaction zone of step (c).

2. The process of claim 1 wherein said first residual oil comprises atmospheric crude tower bottoms, vacuum tower bottoms or catalyst sludge.

3. The process of claim 1 wherein said second residual oil comprises vacuum tower bottoms, atmospheric crude tower bottoms or catalyst sludge.

4. The process of claim 2 wherein said catalyst sludge is obtained from a slurry catalyst process which hydrotreats a high metal content hydrocarbon.

5. The process of claim 3 wherein said catalyst sludge is obtained from a slurry catalyst process which hydrotreats a high metal content hydrocarbon.

6. The process of claim 1 wherein said solvent extraction conditions include a temperature from about 400° F. to about 950° F., a pressure from about 500 to about 5,000 psig, a coal solvent to coal weight ratio from about 0.1 to about 10, a residence time from about 30 seconds to about 10 hours and a hydrogen circulation rate from about 1000 to about 10,000 standard cubic feet per barrel of feed.

7. The process of claim 1 wherein the residual oil to coal weight ratio is from about 0.01 to about 10.

8. The process of claim 1 wherein said first residual oil contains from about 0.01 to about 25 weight percent metal based on the elemental metal.

9. The process of claim 1 wherein said second residual oil contains from about 0.01 to about 25 weight percent metal based on the elemental metal.

10. The process of claim 1 wherein said first residual oil contains from about 2.0 to about 10 weight percent metal based on the elemental metal.

11. The process of claim 1 wherein said second residual oil contains from about 2.0 to about 10 weight percent metal based on the elemental metal.

12. The process of claim 1 wherein said metal is a Group V-B metal.

13. The process of claim 1 wherein said metal is a Group VI-B metal.

14. The process of claim 1 wherein said metal is a Group VIII metal.

15. The process of claim 1 wherein said Group V-B metal is vanadium.

16. The process of claim 1 wherein said Group VI-B metal is molybdenum.

17. The process of claim 1 wherein said Group VIII metal is nickel.

18. The process of claim 1 wherein said coal solvent comprises hydrocarbons previously derived from coal liquefaction.

19. The process of claim 1 wherein said coal solvent comprises naphthalenic hydrocarbons.

20. The process of claim 1 wherein the finely divided, unsupported metal sulfide has a nominal diameter from about one micron to about 2000 microns.

21. The process of claim 1 wherein said coal solvent comprises a hydrogenated coal oil which has been hydrogenated to convert at least about 80% of the asphaltenes.

22. The process of claim 1 wherein said hydrogen in step (a) is admixed with hydrogen sulfide in an amount to provide a hydrogen to hydrogen sulfide molar ratio from about 2 to about 200.

23. The process of claim 1 wherein said hydrogen in step (c) is admixed with hydrogen sulfide in an amount to provide a hydrogen to hydrogen sulfide molar ratio from about 2 to about 200.

24. The process of claim 1 wherein said low boiling hydrocarbon solvent is ethane, propane, butane, isobutane, pentane, isopentane, neopentane, hexane, isohentane or mixtures thereof.

25. The process of claim 1 wherein said solvent separation conditions include a low boiling hydrocarbon solvent to liquid effluent slurry volume ratio from about 0.5 to about 10, a temperature from about 32° F. to about 500° F. and a pressure from about ambient to about 700 psig.

26. The process of claim 1 wherein said hydrocarbon conversion conditions include a temperature from about 400° F. to about 950° F., a pressure from about 500 to about 5000 psig, a residual oil to low boiling hydrocarbon soluble stream weight ratio from about 0.1 to about 10, a residence time from about 30 seconds to about 10 hours and a hydrogen circulation rate from about 1000 to about 10,000 standard cubic feet per barrel of feed.

* * * * *